United States Patent [19]

Ishibashi et al.

[11] Patent Number: 4,907,412

[45] Date of Patent: Mar. 13, 1990

[54] REFRIGERATOR

[75] Inventors: Kiyoshi Ishibashi, Toyota; Hideo Mita, Okazaki, both of Japan

[73] Assignee: Aisin Seiki Kabushiki Kaisha, Kariya, Japan

[21] Appl. No.: 25,076

[22] Filed: Mar. 12, 1987

[30] Foreign Application Priority Data

Mar. 13, 1986 [JP] Japan ..... 055727

[51] Int. Cl.[4] ..... F02G 1/06

[52] U.S. Cl. ..... 62/6; 60/520

[58] Field of Search ..... 62/6; 92/171, 165; 417/545

[56] References Cited

U.S. PATENT DOCUMENTS 4,498,296 2/1985 Dijkstra et al. ..... 60/521

FOREIGN PATENT DOCUMENTS 55-72638 5/1980 Japan .

*Primary Examiner*—Henry A. Bennet

*Attorney, Agent, or Firm*—Burns, Doane, Swecker & Mathis

[57] ABSTRACT

A refrigerator includes a working space which is in fluid communication with a vessel of the volume-variable type with a capillary acting as a flow resistance. Each time change of the average cycle pressure in the working space is occurs, the volume of the vessel is varied so as to cancel the pressure-change. Thus, the average cycle pressure in the working space may be kept at a set value.

9 Claims, 2 Drawing Sheets

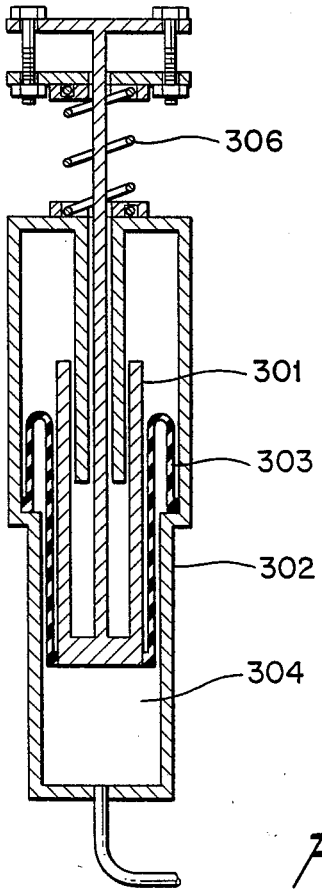
Fig. 4
Fig. 5
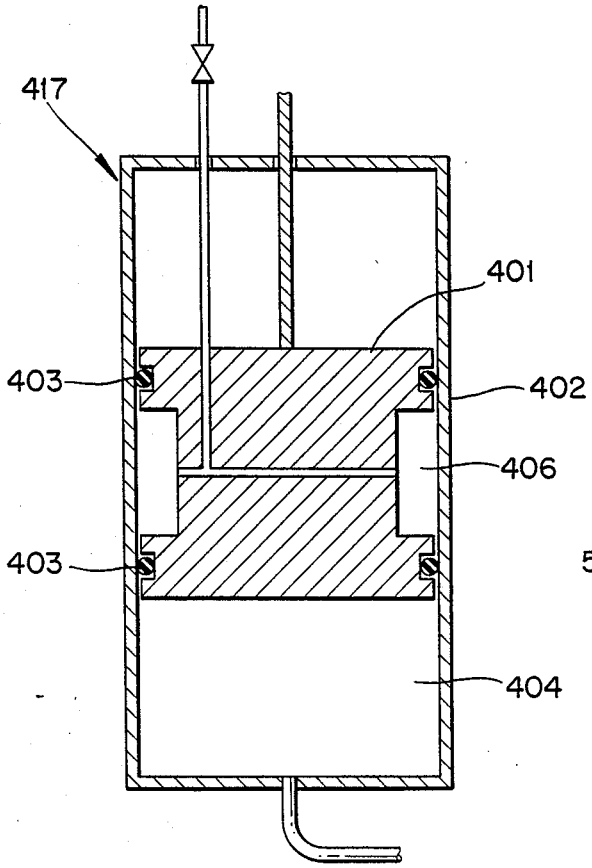
Fig. 6
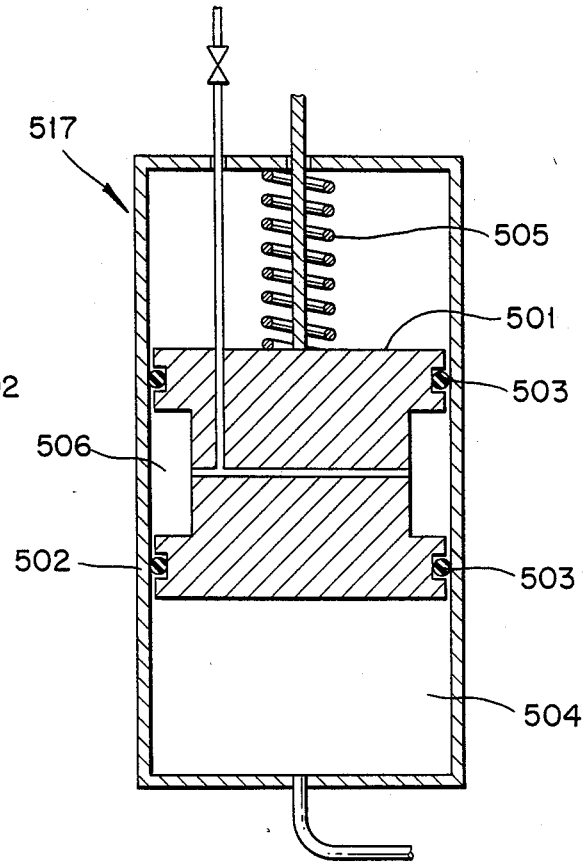

REFRIGERATOR

BACKGROUND OF THE INVENTION

1. Field of the Invention

The present invention relates to a refrigerator which can efficiently produce a very low temperature, and in particular to a device for supplying a working medium to a working space in the refrigerator.

2. Description of Prior Art

In Japanese Patent application No. 55-72638 which has been laid open without examination on May 31, 1980, a refrigerator is disclosed which includes a working space which is fluidly connected with an intermediate pressure chamber via capillary section. A working medium, under a pressure corresponding to the average cycle pressure in the working space, is supplied continually from the intermediate pressure chamber to the working space via the capillary until the refrigerator is brought steady state.

In the aforementioned refrigerator, the average cycle pressure in the working space is increased upon an increase in the load to be refrigerated at a refrigerating station due to heat transfer to the refrigerating section thereto from outside the station. This results in a temperature, at which the working medium is liquefied, becoming unstable.

SUMMARY OF THE INVENTION

It is, therefore, an object of the present invention to provide a refrigerator without the aforementioned drawback.

According to the present invention, a working space of a refrigerator is in fluid communication with a variable-volume type vessel via a flow resistor element in the form of a capillary. Thus, the volume of the vessel varies immediately in response to a change in the average cycle pressure in the working space with the result that the average cycle pressure in the working space may be kept at a set value.

BRIEF DESCRIPTION OF THE DRAWINGS

FIG. 4 is a schematic representation of a modification of the variable volume vessel shown in FIG. 3;

FIG. 5 is a schematic representation of an embodiment of a variable volume vessel shown in FIG. 1; and FIG. 6 is a schematic representation of a modification of the variable volume vessel shown in FIG. 5.

DESCRIPTION OF THE PREFERRED EMBODIMENT

Figure 1:
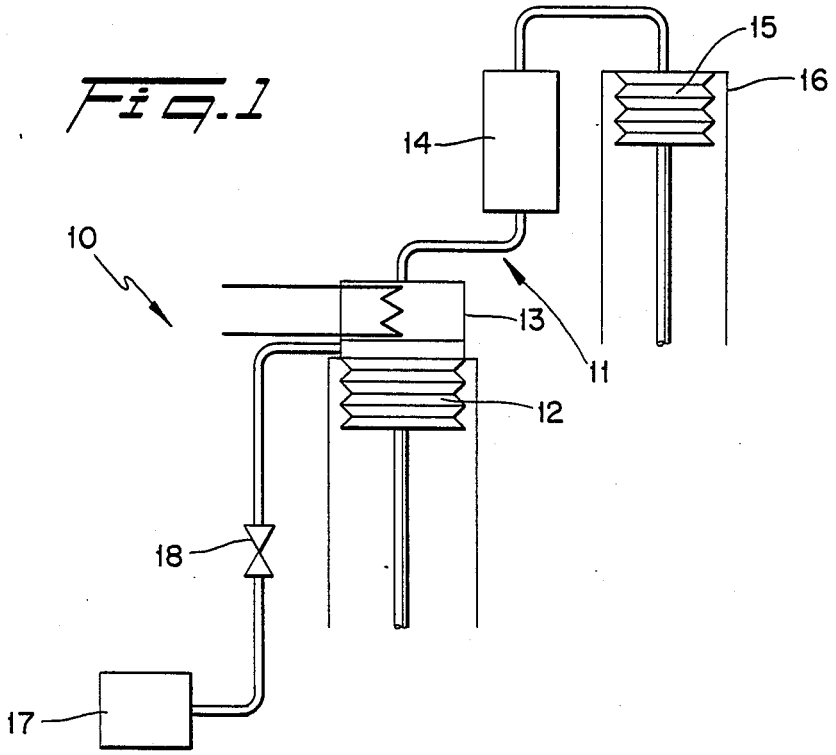
FIG. 1 is a view showing a basic construction of a refrigerator in accordance with the present invention.

Referring now to FIG. 1, a refrigerator 10 according to the present invention is shown schematically in a block-diagram manner. The refrigerator 10 includes a working space 11 which is constituted by connecting a compression chamber 12, a cooler 13, a cryoretainer 14 and an expansion chamber 15. A refrigerating station 16 at which a member or item (not shown) to be refrigerated is provided around the expansion chamber 15. The working space 11 is also connected to a vessel 17 via a flow resistance element or restrictor 18 which is constructed or is in the form of a capillary section or tube.

As a result, the vessel 17 is fluidly connected with the average cycle pressure of the working space 11. The vessel 17 serves as a storage reservoir for storing therein working medium of the refrigerator under a pressure corresponding to the average cycle pressure of the working space 11. Accordingly, the volume of the vessel 17 is variable.

When the thermal capacity at the refrigerating station 16 is increased due to heat invasion thereto from outside of the refrigerator 10, the average cycle pressure in the working space 11 is increased. The working medium, under the resulting average cycle pressure, is then moved in the vessel 17 via the flow resistance element or restrictor 18. The volume of the vessel 17 is variable so that an increment of the average cycle pressure in the working space 11 is transformed into a volume expansion of the working medium in the vessel 17. Thus, as a whole, the average cycle pressure is kept at a set or predetermined value in spite of an increase of the thermal capacity at the refrigerating station 16. On the other hand, upon a decrease of the average cycle pressure in the working space 11, a decrement of the pressure is immediately compensated by the working medium supplied to the space 11 from the vessel 17 having a decreasing or shrinking volume thereof. Thus, the average cycle pressure is being kept at a set value. Accordingly, a temperature at which the working medium is liquified is kept at a constant or substantially contant.

Figure 2:
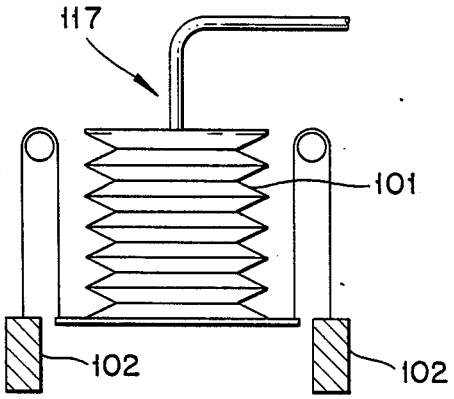
FIG. 2 is a schematic representation of a variable volume vessel of the type shown in FIG. 1.

Hereinafter, various types and configurations of the vessel 17 are shown. In FIG. 2, a vessel 117 has a main body 101 in the form of bellows configuration. For adjusting pressure of the working medium in the main body 101, a pair of balancers or counterweights 102, 102 are employed. The weight of each balancer 102 is controlled so as to balance the pressure in the main body 101 and the average cycle pressure in the working space 21. Pressure in the main body 101 is set at 1.1 atm.

Figure 3:
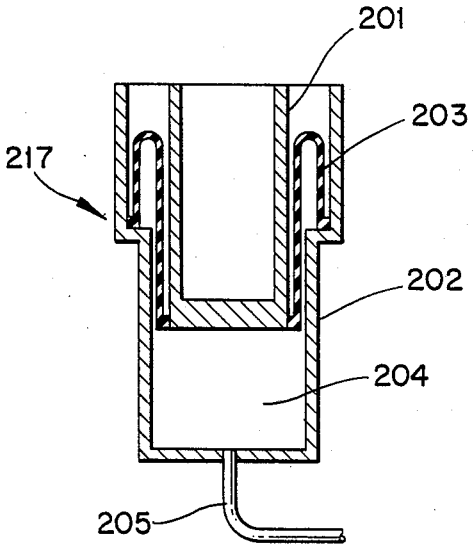
FIG. 3 is a schematic representation of an embodiment of a variable volume vessel shown in FIG. 1.

In FIG. 3, a vessel 217 has an outer casing 202, an inner casing 201 movably fitted therein and a deformable sealing member 203 disposed between the casings 201, 202 and connected thereto. A space 204 defined by the members 201, 202 and 203 is of variable volume configuration. By adjusting weight or position of the inner casing 201, with respect to the outer casing 202, the volume of the space 204 is adjusted and the working medium in the space 204 may be balanced to the average cycle pressure in the working space 11.

In FIG. 4, an inner casing 301 is movably fitted or received in an outer casing 302. A deformable sealing member 303 is connected between the casings 301 and 302. In this embodiment, the tension of a spring 306 is used for balancing the pressure in a space 304 to the average pressure in the working space 11.

In FIG. 5, a vessel 417 has a space 404 for storing a working medium therein. The space is defined by a cylinder 402 and a movable piston 401 fitted therein. On the piston 401, a pair of axially spaced O-rings 403 is provided. Between the O-rings 403 is a vacuum space 406 which is fluidly connected to a vacuum source (not shown) so as to prevent air entering into the space 404. For balancing pressure in the space 404 and the average cycle pressure, the weight of the piston 401 may be adjusted in a suitable manner.

A vessel 517 shown in FIG. 6 is similar to the vessel 417 shown in FIG. 5. However, a spring 505 is utilized as an adjusting device for balancing pressure in a space 504 and consequently the average cycle pressure in the working space 11.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A refrigerator comprising:

an expansion chamber;

a compression chamber operatively connected to said expansion chamber to form a working space;

a vessel connected to said working space and having a variable volume for storming therein a working medium under a pressure balanced to the average cycle pressure in said working space; and capillary means for providing a flow restriction between said working space and said vessel wherein said vessel comprises a bellows arrangement defining a closed space.

2. A refrigerator, comprising:

a working space that includes a compression chamber and an expansion chamber connected to the compression chamber;

a vessel having a variable volume for therein storing a working medium under a pressure balanced to the average cycle pressure in said working space; and capillary means for providing a flow restriction and being positioned between said working space and said vessel;

said vessel includes an outer member and an inner member, said outer member and inner member being movable with respect to each other, said vessel further includes a sealing element positioned between said outer and inner members, said variable volume being defined by said outer member, said inner member and said sealing element.

3. A refrigerator, comprising:

a working space that includes a compression chamber and an expansion chamber connected to the compression chamber ;

a vessel having a variable volume for therein storing a working medium under a pressure balanced to the average cycle pressure in said working space; and capillary means for providing a flow restriction and being positioned between said working space and said vessel;

said vessel includes an outer member, an inner member movable with respect to said outer member and a sealing element positioned between said outer and inner members, said variable volume being defined by said outer member, said inner member and said sealing element.

4. A refrigerator in accordance with claim 3, wherein said sealing element is a deformable diaphragm.

5. A refrigerator in accordance with claim 3, wherein said sealing element is a O-ring provided on said inner member.

6. A refrigerator in accordance with claim 4 wherein said sealing element is a pair of O-rings provided on said inner member, said inner member, said outer member and said O-rings defining a vacuum space.

7. A refrigerator in accordance with claim 4 further comprising a regulator means for adjusting said volume prior to operation.

8. A refrigerator in accordance with claim 7, wherein said regulator means is a spring for biasing said inner member.

9. A refrigerator in accordance with claim 1, further comprising regulator means for adjusting an axial length of said bellows.

* * * * *